US012419475B2

(12) United States Patent
Liu et al.

(10) Patent No.: US 12,419,475 B2
(45) Date of Patent: Sep. 23, 2025

(54) VACUUM CLEANER

(71) Applicant: TECHTRONIC CORDLESS GP, Anderson, SC (US)

(72) Inventors: Hui Shu Liu, Dongguan (CN); Yun Qiang Xin, Dongguan (CN)

(73) Assignee: Techtronic Cordless GP, Anderson, SC (US)

( * ) Notice: Subject to any disclaimer, the term of this patent is extended or adjusted under 35 U.S.C. 154(b) by 73 days.

(21) Appl. No.: 17/868,392

(22) Filed: Jul. 19, 2022

(65) Prior Publication Data

US 2023/0140788 A1 May 4, 2023

(30) Foreign Application Priority Data

Nov. 3, 2021 (CN) ..... 202122670688.2
May 9, 2022 (CN) ..... 202210498029.1

(51) Int. Cl.
*A47L 9/04* (2006.01)
*A47L 5/30* (2006.01)

(52) U.S. Cl.
CPC ..... *A47L 9/0477* (2013.01); *A47L 5/30* (2013.01)

(58) Field of Classification Search
CPC ..... A47L 9/0054; A47L 9/009; A47L 9/24; A47L 9/242; A47L 9/244; A47L 9/246; A47L 9/248; A47L 5/30; A47L 5/28
USPC ..... 15/410, 350
See application file for complete search history.

(56) References Cited

U.S. PATENT DOCUMENTS 2,734,218 A 2/1956 Vance
2,740,983 A 4/1956 Humphrey
4,095,304 A 6/1978 Shinozaki et al.
4,129,920 A 12/1978 Evans et al.
4,423,534 A * 1/1984 Lyman ..... A47L 9/32 15/410
5,584,095 A 12/1996 Redding et al.
6,006,401 A 12/1999 Jailor et al.
(Continued)

FOREIGN PATENT DOCUMENTS

CN 1768660 A 5/2006
CN 102688001 A 9/2012
(Continued)

OTHER PUBLICATIONS

Translation of JP-2015042320-A (Year: 2023).*
Extended European Search Report for Application No. 22202108.1 dated May 23, 2023 (7 pages).

*Primary Examiner* — Edward F Landrum
*Assistant Examiner* — Sarah Akyaa Fordjour
(74) *Attorney, Agent, or Firm* — Michael Best & Friedrich LLP

(57) ABSTRACT

A vacuum cleaner comprising a handpiece, a brush, a rod, and a pivotal assembly that connects the handpiece and the brush. The pivotal assembly comprises a pivotal tube and a pivotal saddle, the pivotal saddle being pivotally connected to the brush about a first axis such that the pivotal saddle is turnable back and forth relative to the brush; the pivotal tube and the pivotal saddle are pivotally connected about a second axis, the pivotal tube being provided with a joint portion, the brush being provided with a fitting portion, the joint portion and the fitting portion being capable of engaging with each other, so that the pivotal tube is locked and not pivotable about the second axis.

25 Claims, 11 Drawing Sheets

(56) References Cited

U.S. PATENT DOCUMENTS

| | | | |
|---|---|---|---|
| 6,055,703 | A | 5/2000 | Redding et al. |
| 6,058,559 | A | 5/2000 | Yoshimi et al. |
| 6,553,613 | B2 | 4/2003 | Onishi et al. |
| 6,678,916 | B2 | 1/2004 | Hashizume et al. |
| 6,818,036 | B1 | 11/2004 | Seaman |
| 6,823,559 | B2 | 11/2004 | Kaffenberger et al. |
| 7,350,266 | B2 | 4/2008 | Park et al. |
| 7,503,098 | B2 | 3/2009 | Stein |
| 7,594,297 | B2 | 9/2009 | Choi |
| 7,607,196 | B2 | 10/2009 | Li |
| 7,665,172 | B1 | 2/2010 | Tran et al. |
| 7,669,281 | B2 | 3/2010 | Fukuda et al. |
| 7,789,922 | B1 | 9/2010 | Wai |
| 7,836,544 | B2 | 11/2010 | Jansen |
| 8,020,251 | B2 | 9/2011 | Luebbering et al. |
| 8,060,981 | B2 | 11/2011 | Bassett et al. |
| 8,091,169 | B2 | 1/2012 | Jeutter et al. |
| 8,181,309 | B2 | 5/2012 | Mersmann et al. |
| 8,336,165 | B2 | 12/2012 | Finke et al. |
| 8,365,347 | B2 | 2/2013 | Morgan et al. |
| 8,429,791 | B2 | 4/2013 | White |
| 8,448,295 | B2 | 5/2013 | Vines et al. |
| 8,479,358 | B2 | 7/2013 | Conrad |
| 8,539,636 | B2 | 9/2013 | White et al. |
| 8,595,897 | B2 | 12/2013 | Vines |
| 8,627,545 | B2 | 1/2014 | Streciwilk |
| 8,671,511 | B2 | 3/2014 | Wills et al. |
| 8,683,647 | B2 | 4/2014 | Ford et al. |
| 8,713,754 | B2 | 5/2014 | Conrad |
| 8,789,238 | B2 | 7/2014 | Myers |
| 8,813,308 | B2 | 8/2014 | Xue |
| 8,869,349 | B2 | 10/2014 | Henderson |
| 8,935,826 | B2 | 1/2015 | Dyson et al. |
| 9,009,913 | B2 | 4/2015 | Wills et al. |
| 9,232,878 | B2 | 1/2016 | Seo |
| 9,282,862 | B2 | 3/2016 | Henderson et al. |
| 9,326,653 | B2 | 5/2016 | White et al. |
| 9,560,944 | B2 | 2/2017 | Grey |
| 9,622,630 | B2 | 4/2017 | Faremo et al. |
| 9,668,631 | B2 | 6/2017 | Conrad |
| 9,675,218 | B2 | 6/2017 | Kim et al. |
| 9,717,382 | B2 | 8/2017 | Morgan |
| 9,999,333 | B2 | 6/2018 | Thorne et al. |
| 10,016,107 | B2 | 7/2018 | Thorne |
| 10,285,548 | B2 | 5/2019 | Gu et al. |
| 10,299,649 | B2 | 5/2019 | Conrad |
| 10,327,609 | B2 | 6/2019 | Conrad |
| 10,413,142 | B2 | 9/2019 | Hwang et al. |
| 10,624,509 | B2 | 4/2020 | Wang et al. |
| 10,791,900 | B2 | 10/2020 | Tran et al. |
| 10,893,783 | B2 | 1/2021 | Conrad |
| 10,952,579 | B2 | 3/2021 | Knight Adams et al. |
| 2001/0037536 | A1* | 11/2001 | Kim ..... A47L 9/02 15/361 |
| 2006/0080803 | A1 | 4/2006 | Stein |
| 2008/0141472 | A1* | 6/2008 | Jeutter ..... A47L 11/4075 15/41.1 |
| 2008/0263814 | A1 | 10/2008 | Bassett et al. |
| 2009/0064449 | A1 | 3/2009 | Newton et al. |
| 2009/0064450 | A1 | 3/2009 | Newton et al. |
| 2011/0088208 | A1 | 4/2011 | White et al. |
| 2012/0124768 | A1 | 5/2012 | Xue |
| 2013/0315653 | A1* | 11/2013 | Jalbert ..... B25G 3/38 403/119 |
| 2014/0041149 | A1 | 2/2014 | Henderson et al. |
| 2014/0331445 | A1 | 11/2014 | Thorne et al. |
| 2016/0157690 | A1 | 6/2016 | Streciwilk et al. |
| 2017/0319025 | A1* | 11/2017 | Hu ..... A47L 9/2863 |
| 2019/0069740 | A1 | 3/2019 | Thorne et al. |
| 2019/0246851 | A1 | 8/2019 | Li |
| 2020/0000304 | A1 | 1/2020 | Holmes et al. |
| 2020/0221914 | A1* | 7/2020 | Kim ..... A47L 9/02 |
| 2020/0315414 | A1* | 10/2020 | Kovacs ..... A47L 9/009 |
| 2021/0315428 | A1 | 10/2021 | Udy et al. |
| 2022/0022710 | A1* | 1/2022 | Lee ..... A47L 9/242 |
| 2022/0409003 | A1* | 12/2022 | Protz ..... A47L 5/30 |

FOREIGN PATENT DOCUMENTS

| | | | | |
|---|---|---|---|---|
| CN | 105902238 | B | | 5/2018 |
| CN | 207429046 | U | | 6/2018 |
| CN | 207492730 | U | | 6/2018 |
| CN | 208582323 | U | | 3/2019 |
| CN | 209346879 | U | | 9/2019 |
| CN | 209529024 | U | | 10/2019 |
| CN | 110448218 | A | | 11/2019 |
| CN | 110876579 | A | | 3/2020 |
| CN | 210249724 | U | | 4/2020 |
| CN | 210871317 | U | | 6/2020 |
| CN | 210871345 | U | | 6/2020 |
| CN | 111358339 | A | | 7/2020 |
| CN | 111358340 | A | | 7/2020 |
| CN | 108903838 | B | | 9/2020 |
| CN | 213910036 | U | | 8/2021 |
| CN | 215016701 | U | | 12/2021 |
| EP | 2989956 | A1 | | 3/2016 |
| EP | 3695767 | A1 | | 8/2020 |
| JP | 2015042320 | A | * | 3/2015 |
| JP | 2017000393 | A | | 1/2017 |
| WO | 2007031142 | A1 | | 3/2007 |
| WO | 2013055364 | A1 | | 4/2013 |
| WO | 2016141953 | A1 | | 9/2016 |
| WO | 2019233554 | A1 | | 12/2019 |

* cited by examiner

VACUUM CLEANER

TECHNICAL FIELD

The present invention relates to a vacuum cleaner comprising a handpiece, a brush, a rod, and a pivotal assembly that connects the handpiece and the brush. The pivotal assembly makes the vacuum cleaner self-standing without leaning against an external object, for example, a wall.

BACKGROUND ART

Vacuum cleaners are well known, among which upright and cylinder vacuum cleaners, especially, are increasingly popular with consumers because they are easy to operate and recovery containers are separable from the vacuum cleaners.

A cylinder vacuum cleaner comprises a front brush for cleaning a floor to be cleaned, movable joints or pivotal members being usually provided between the front brush and the rod as well as the handle grip, so that the user can change the cleaning direction anytime and anywhere as needed, thus cleaning the floor conveniently. Such movable joints or pivotal members, while greatly improving the cleaning experience of the user, are so flexible that it is difficult to lock the handpiece to the brush on the floor, because such a movable joint or pivotal member may topple over leftward, rightward, forward, or backward under the gravity of the handpiece. In practice, a cylinder vacuum cleaner, rather than being placed integrally on the floor, usually needs to be disassembled for storage or integrally hung on a wall, which causes considerable inconveniences in storage.

In addition, when the user needs to turn off the cylinder vacuum cleaner in order to handle another matter, the vacuum cleaner needs to be disassembled and mounted because it cannot be placed integrally on the floor, and when the user proceeds with the cleaning with the cylinder vacuum cleaner after handling the matter, he/she needs to perform a lot of disassembly steps, which take a long time, creating an unpleasant cleaning experience.

Therefore, there is still a need in the art to provide an improved vacuum cleaner structurally designed for being integrally placed on a floor, so that the vacuum cleaner remains self-standing on the floor without the need to perform any additional steps such as disassembly and mounting, nor does it need to be hung on a wall.

SUMMARY OF THE INVENTION

An objective of the present invention is to provide an improved vacuum cleaner that remains self-standing without leaning against any external objects, such as a wall.

According to a first aspect of the present invention, a vacuum cleaner is provided, comprising a handpiece, a brush, a rod, and a pivotal assembly that connects the handpiece and the brush, wherein the pivotal assembly comprises a pivotal tube and a pivotal saddle, the pivotal saddle being pivotally connected to the brush about a first axis such that the pivotal saddle is turnable back and forth relative to the brush; and the pivotal tube and the pivotal saddle are pivotally connected about a second axis, the pivotal tube being provided with a joint portion, the brush being provided with a fitting portion, the joint portion and the fitting portion being capable of engaging with each other, so that the pivotal tube is locked and not pivotable about the second axis. The brush is configured to engage with the pivotal tube such that the pivotal tube is locked in place. This enables the vacuum cleaner to remain self-standing, without the need to lean against any external objects, such as a wall. Thus, the user can place the vacuum cleaner on the floor at any time with the handpiece remaining upright on the front brush attachment, without the need to perform any additional steps, such as disassembly and mounting.

In a preferred solution of the first aspect of the present invention, the fitting portion comprises a groove adjacent to an end of the pivotal tube, and the joint portion comprises a dovetail portion at the lower end of the pivotal tube, the dovetail portion being configured to be insertable into the groove.

In a preferred solution of the first aspect of the present invention, the pivotal tube comprises a pivotal portion at the lower end thereof and the groove opens vertically upward, so that the dovetail portion is insertable into the groove when the pivotal tube is in a vertical plane passing through the pivotal portion.

In a preferred solution of the first aspect of the present invention, the pivotal tube comprises a pivotal portion at the lower end thereof, the pivotal portion comprising a pivotal slope, and the pivotal saddle comprises another pivotal portion at the upper end thereof, said other pivotal portion comprising another pivotal slope, wherein the pivotal slope and said other pivotal slope form an included angle between 30 degrees and 40 degrees when the pivotal tube is pivotally connected to the pivotal saddle. The included angle is more preferably 37 degrees.

In a preferred solution of the first aspect of the present invention, the brush is formed with a support surface on both sides of the groove, the dovetail portion comprising protrusions extending outwardly on both sides thereof, the support surface being configured to abut the protrusions of the dovetail portion.

In a preferred solution of the first aspect of the present invention, the groove is provided with a slope at the entrance thereof, which makes it easier to insert the dovetail portion.

In a preferred solution of the first aspect of the present invention, the support surface is an inclined plane that tilts slightly forward. Thus, the rod and the handpiece, that is, the handpiece as a whole, are prevented from toppling over backward, so that the self-standing structure becomes more stable.

In a preferred solution of the first aspect of the present invention, the brush comprises two front wheels and two rear wheels arranged adjacent to the pivotal saddle, and the center of gravity of the handpiece is between the front wheels and the rear wheels. With this arrangement, when the vacuum cleaner is placed upright, the overall gravity of the handpiece is projected onto the floor and the projection of gravity is inside the quadrilateral formed by the two front wheels and the two rear wheels, which better ensures that the vacuum cleaner is self-standing more stably.

In a preferred solution of the first aspect of the present invention, a cam is fixedly connected to the pivotal saddle, and an elastic piece is fixed to the brush, the cam being lockable into the elastic piece to prevent the pivotal saddle from pivoting backward.

In a preferred solution of the first aspect of the present invention, the cam comprises a projection protruding radially outward, and the elastic piece is formed with an elastic piece groove for engaging with the projection of the cam.

In a preferred solution of the first aspect of the present invention, the fitting portion comprises a dovetail portion adjacent to one end of the pivotal tube, and the joint portion comprises a groove at the lower end of the pivotal tube, the dovetail portion being configured to be insertable into the groove. When the rod and the handpiece are placed upright, the cam, through the protrusion thereof, automatically locks into the elastic piece groove, which also helps to prevent the handpiece from toppling over backward and thus makes the self-standing structure more stable.

In a preferred solution of the first aspect of the present invention, the brush comprises an upper housing and a locking block, the locking block being slidable on the upper housing, the locking block comprising a locking groove as the fitting portion, wherein, when the pivotal tube is pivoted to an upright position, the joint portion comes into contact with the locking block and causes the locking block to slide, thus facilitating the engagement of the joint portion into the locking groove.

In a preferred solution of the first aspect of the present invention, an elastic biasing element is provided between the upper housing and the locking block, the elastic biasing element being configured to bias the locking block away from the upper housing, the elastic biasing element being preferably a spring.

In a preferred solution of the first aspect of the present invention, the locking block is provided with an angled guide surface for guiding the joint portion into the locking groove.

In a preferred solution of the first aspect of the present invention, shape-fitting structures are provided on the lower surface of the locking block and on the upper surface of the upper housing so that the locking block is slidable on the upper housing.

In a preferred solution of the first aspect of the present invention, the locking block comprises a rail, and the upper housing comprises a chute.

In a preferred solution of the first aspect of the present invention, the locking block comprises a stop structure configured to abut the upper housing to prevent an elastic biasing element from pushing the locking block further away on the upper housing, the stop structure preferably being a lug on a lateral surface of the locking block.

In a preferred solution of the first aspect of the present invention, the front end of the locking block is provided with a protrusion to receive one end of the spring thereon, the protrusion preferably having the shape of a cross.

In a preferred solution of the first aspect of the present invention, the locking block is made of a high-hardness plastic or metal material, for example, ultrahigh molecular weight polyethylene or polyetherketoneketone (PEKK).

In a preferred solution of the first aspect of the present invention, the maximum sliding stroke of the locking block on the upper housing is greater than the maximum actual pushing stroke in the front-rear direction when the joint portion pivots relative to the brush.

In a preferred solution of the first aspect of the present invention, the brush further comprises an upper housing cover fixed on the upper housing, the locking block being accommodated in the upper housing and the upper housing cover.

In a preferred solution of the present invention, the locking block preferably comprises an angled guide surface, lugs provided on lateral surfaces thereof, and shape-fitting structures provided on the lower surface of the locking block and on the upper surface of the upper housing, all of which are designs that help to better absorb the positional deviation between the dovetail portion and the locking groove when the pivotal tube or the handpiece is locked relative to the brush or the upper housing, reducing the damage caused between the dovetail portion and the locking groove or the locking block, wherein, compared with a case where no locking block is present, since the locking block is movable forward relative to the lower housing to reduce the frictional force generated when the pivotal member is inserted into the upper housing, risks of possible breakage of any parts due to misalignment are reduced or avoided.

BRIEF DESCRIPTION OF DRAWINGS

Objectives and characteristics of the present invention will become apparent from the following detailed description considered in conjunction with the drawings. It should be understood, however, that the drawings are designed for illustrative purposes only, rather than being intended to limit the present invention.

SPECIFIC EMBODIMENTS

Figure 1:
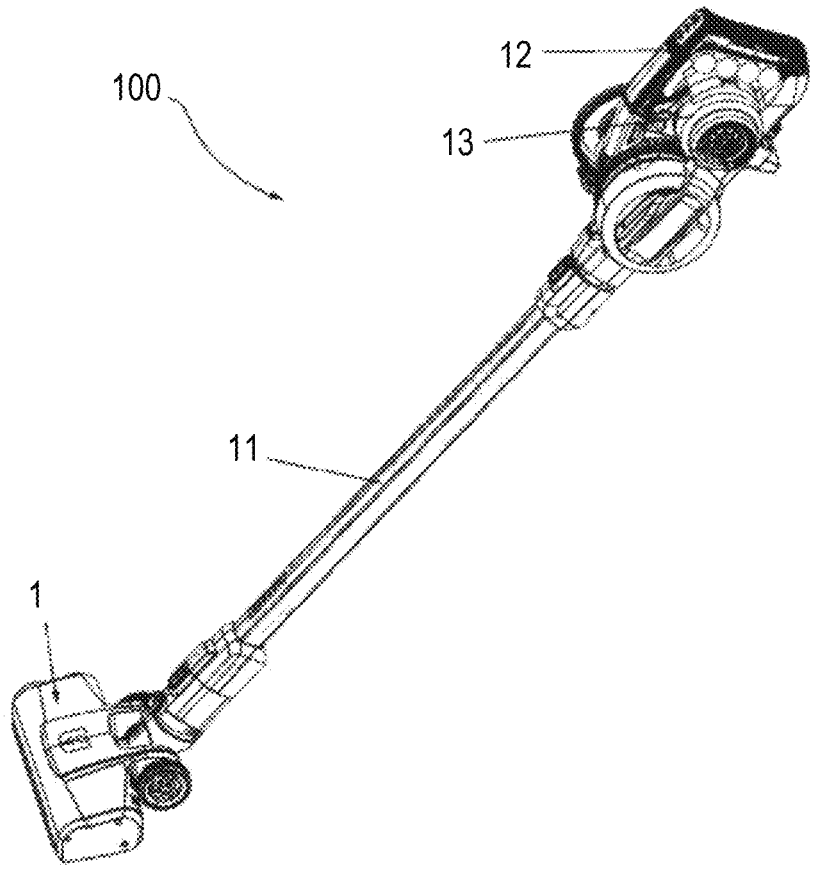
FIG. 1 is a perspective view of a vacuum cleaner according to an embodiment of the present application.

Technical solutions of the present invention will be clearly and completely described below in conjunction with the drawings, and, obviously, the described embodiments are only some, but not all, embodiments of the present invention. Any embodiments obtained by those of ordinary skill in the art on the basis of the described embodiments of the present invention without making inventive efforts fall into the protection scope of the present invention.

Note that in the description of the present invention, unless otherwise expressly specified or limited, "connection" and other terms should be understood in a broad sense, which, for example, may be a fixed connection, a detachable connection, or an integrated connection; a mechanical connection or an electrical connection; a direct connection or a connection established through an intermediate medium. Those of ordinary skill in the art can understand the specific meanings of the aforesaid terms in the present invention based on actual circumstances. In addition, in the description of the present invention, unless otherwise specified, the phrase "a plurality of" indicates two or more. It should also be noted that orientations or positional relationships indicated by terms such as "central", "longitudinal", "lateral", "upper", "lower", "front", "rear", "left", "right", "vertical", "horizontal", "top", "bottom", "inner", "outer", "axial", "radial", and "circumferential" are usually based on the orientations or positional relationships shown in the drawings, are only intended for convenience of describing the present invention and brevity of description, rather than indicating or implying that the device or element referred to necessarily has a specific orientation or is constructed and operated in a specific orientation, and therefore should not be understood as a limitation of the protection scope of the present invention.

Reference terms including "an embodiment", "certain embodiments", "example", "specific example", and "certain examples" as mentioned throughout this description mean that specific features, structures, materials, or characteristics described in conjunction with the embodiment or example are contained in at least one embodiment or example of the present invention. In the present description, a suggestive expression of one of the above-mentioned terms does not necessarily refer to the same embodiment or example. In addition, specific features, structures, materials, or characteristics described may be combined in an appropriate manner in any or a plurality of embodiments or examples.

To allow those of ordinary skill in the art to easily understand the technical solution of the present invention, the technical solution of the present invention will be further described below in conjunction with the drawings, in which the same reference signs denote the same or similar elements.

Figure 2:
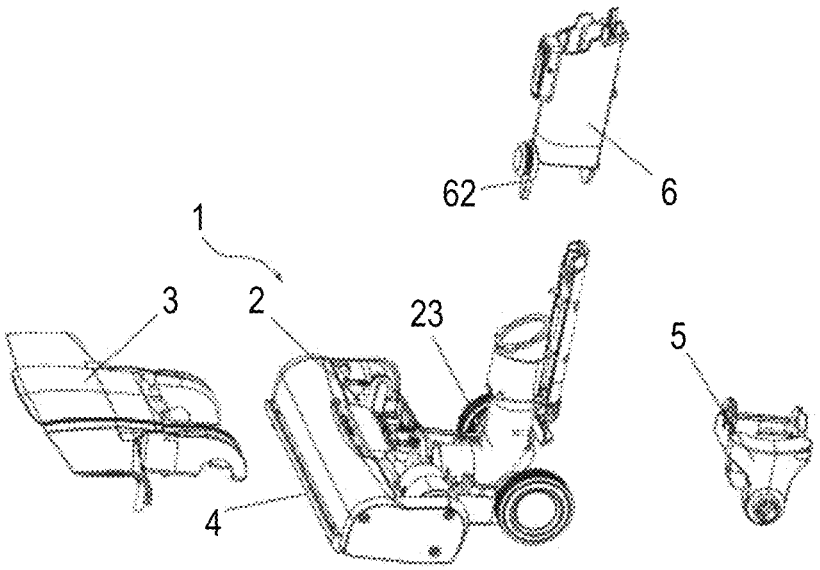
FIG. 2 is an exploded perspective view of a portion of a vacuum cleaner according to an embodiment of the present application.
Figure 3:
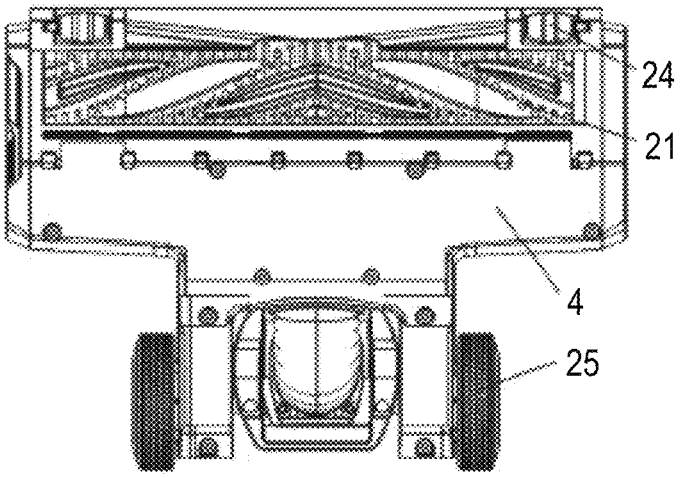
FIG. 3 is a bottom view of a vacuum cleaner according to an embodiment of the present application.

The present application relates to a vacuum cleaner. Referring to the drawings, FIG. 1 is a perspective view of a vacuum cleaner 100 according to an embodiment of the present application. FIG. 2 is an exploded perspective view of the brush 1 and the pivotal assembly for the vacuum cleaner 100 according to an embodiment of the present application. FIG. 3 is a bottom view of the vacuum cleaner 100 of an embodiment of the present application. In the present application, the user cleans the floor by holding the vacuum cleaner 100 behind the vacuum cleaner 100 and causing the handpiece to form an obtuse angle with the brush 1 as shown in FIG. 1, which means that the user stands behind the vacuum cleaner when operating it, with the front, rear, left, and right directions indicated relative to where the user stands.

Referring to FIG. 1-3, in an embodiment of the present application, the vacuum cleaner 100 comprises a handpiece, a brush 1, a rod 11, and a pivotal assembly that connects the handpiece and the brush 1. In an embodiment of the present application, the brush 1 may comprise: a bottom assembly 2, the bottom assembly comprising a brush roll 21, a brush roll compartment 22 for accommodating the brush roll 21, and a dust suction hose 23 in communication with the brush roll compartment 22 (see FIG. 2-3); and an upper housing 3 and a lower housing 4 (see FIG. 3), the upper housing 3 and the lower housing 4 enclosing the bottom assembly.

In an embodiment of the present application, the pivotal assembly may comprise a pivotal tube 6 and a pivotal saddle 5, the pivotal saddle 5 being pivotally connected to the brush 1 about a first axis X, so that the pivotal saddle 5 is turnable back and forth relative to the brush 1. In an embodiment of the present application, the pivotal tube 6 is pivotally connected to the pivotal saddle 5 about a second axis Y, the pivotal tube 6 being provided with a joint portion that is preferably a dovetail portion, the brush being provided with a fitting portion that is preferably a groove, and the joint portion and the fitting portion can engage with each other so that the pivotal tube is locked and not pivotable about the second axis. In an embodiment of the present application, the pivotal assembly comprises: a pivotal saddle 5 pivotally connected to the lower housing 4 about the first axis X so that the pivotal saddle 5 is turnable back and forth relative to the bottom assembly; and a pivotal tube 6, the pivotal tube 6 being inserted downward into the bottom assembly 2 and accommodating the dust suction hose 23 therein, the pivotal tube 6 being pivotally connected to the pivotal saddle 5 about the second axis Y. In a preferred embodiment, the second axis Y is perpendicular to the first axis X, and the pivotal tube 6 is used to connect to the operating rod and handle grip for dust suction. In an embodiment of the present application, the upper housing 3 is configured to engage with the pivotal tube 6 such that the pivotal tube 6 is locked in place, thereby enabling the vacuum cleaner to remain self-standing without the need to lean against any external objects, such as a wall. Therefore, the user can place the vacuum cleaner on the floor at any time, with the handpiece remaining upright on the floor, without the need to perform any additional steps, such as disassembly and mounting.

With continued reference to FIG. 1, in an embodiment of the present application, the vacuum cleaner 100 comprises a handpiece, a brush 1, a rod 11, and a pivotal assembly that connects the handpiece and the brush 1. In a preferred embodiment, the handpiece comprises a handle grip 12 connected to the rod 11, a recovery container 13, and a vacuum generator (not shown), the recovery container 13 being detachably mounted on the rod 11 or the handle grip 12 and in fluid communication with the dust suction hose to store the dirt conveyed by the dust suction hose into the recovery container.

Referring to FIG. 3, the brush comprises a plurality of front wheels 24 provided as auxiliary wheels adjacent to the brush roller 21 and a plurality of rear wheels 25 provided as main wheels adjacent to the pivotal saddle 5. In an embodiment of the present invention, the brush comprises two symmetrically arranged front wheels 24 and two symmetrically arranged rear wheels 25. In a preferred embodiment, a distance between the two rear wheels 25 is about 150 mm, and a longitudinal distance between the front wheels 24 and the rear wheels 25 is about 160 mm. With this arrangement, when the vacuum cleaner 100 is placed upright, the overall gravity of the handpiece is projected onto the floor and the projection of gravity is inside the quadrilateral formed by the two front wheels and the two rear wheels, which better ensures that the vacuum cleaner is self-standing stably. Preferably, the projection of gravity is located between the front and rear wheels.

Figure 4:
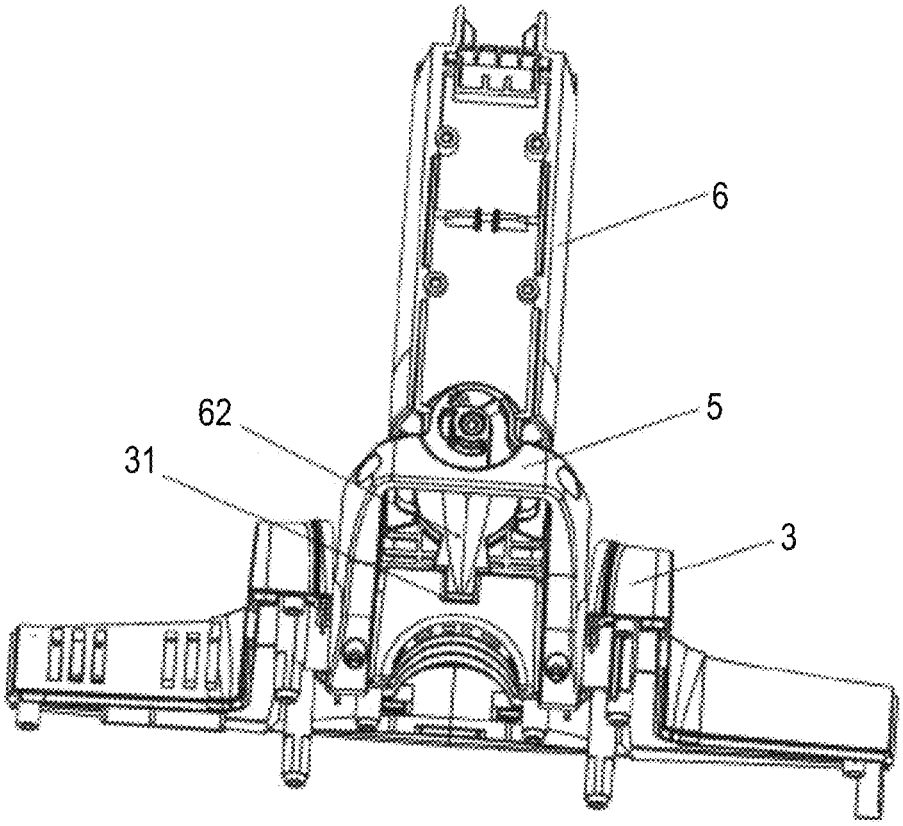
FIG. 4 is a perspective view of a portion of a vacuum cleaner according to an embodiment of the present application with the upper housing, pivotal saddle, and pivotal tube assembled together.
Figure 5:
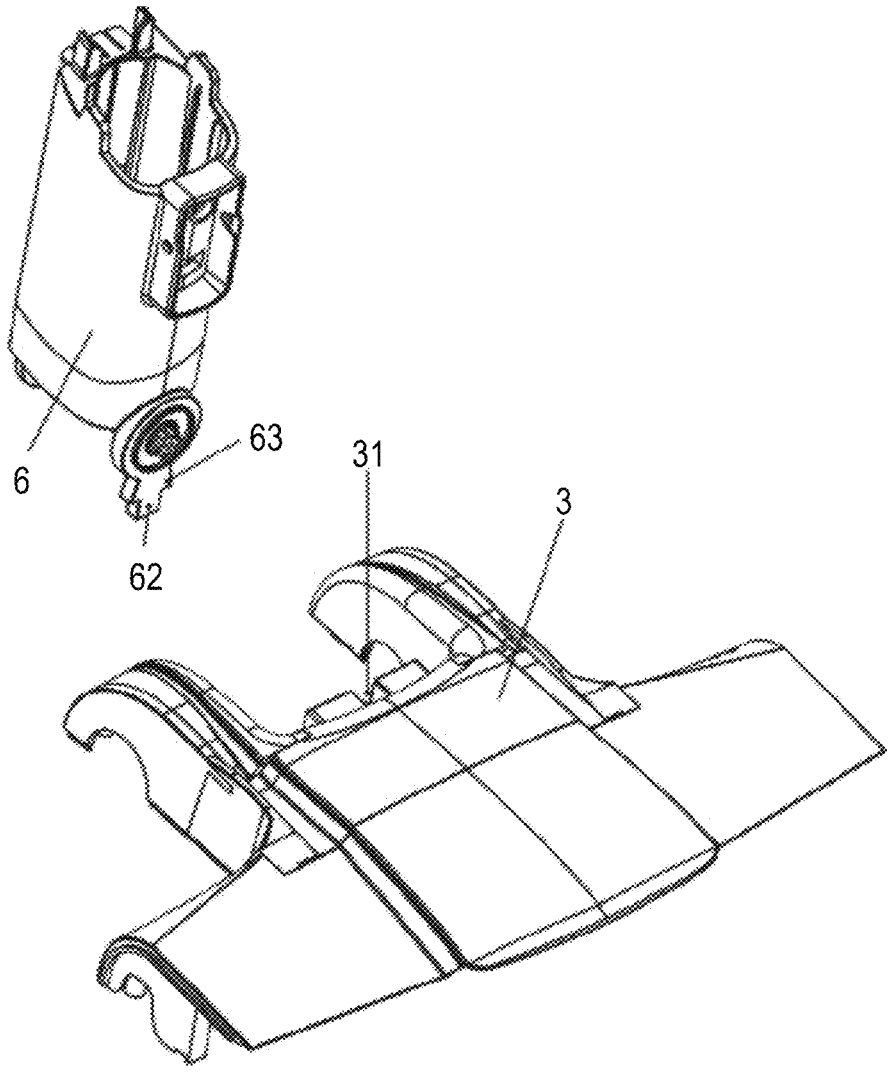
FIG. 5 is an exploded perspective view of the upper housing and pivotal tube of an embodiment of the present application, wherein the pivotal tube comprises a dovetail portion in a lower part of the pivotal portion thereof, and the upper housing comprises a groove that opens upward.

FIG. 4 is a perspective view of a portion of the brush 1 for the vacuum cleaner 100 of an embodiment of the present application, in which the upper housing 3, the pivotal saddle 5, and the pivotal tube 6 are assembled together. FIG. 5 is an exploded perspective view of the upper housing 3 and the pivotal tube 6 of an embodiment of the present application. Referring to FIGS. 4-5 and with continued reference to FIG. 1-3, the pivotal tube 6 comprises a dovetail portion 62 in a lower part of the pivotal portion 61 thereof, and the upper housing 3 comprises a groove 31 that opens upward. The groove 31 is located at the end of the upper housing 3 that is adjacent to the pivotal tube 6.

Figure 6:
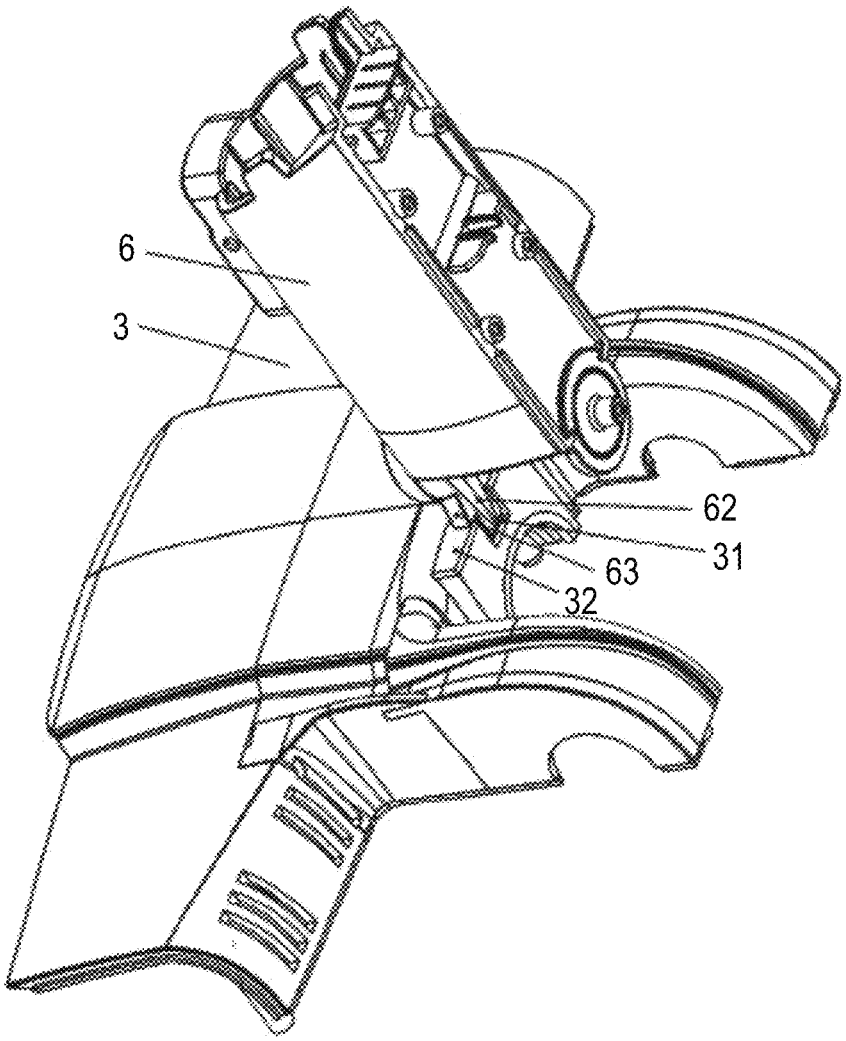
FIG. 6 is a perspective view of an embodiment of the present application with the upper housing and pivotal tube assembled together, wherein the pivotal tube, through the dovetail portion thereof, is inserted into the groove of the upper housing.

FIG. 6 is a perspective view of an embodiment of the present application with the upper housing 3 and the pivotal tube 6 assembled together, wherein the pivotal tube 6, through the dovetail portion 62 thereof, is inserted into in the groove 31 of the upper housing 3. In an embodiment of the present application, the groove opens vertically upward, so that the dovetail portion 62 is insertable into the groove 31 when the pivotal tube 6 is in a vertical plane passing through the pivotal portion 61. In other words, when the vacuum cleaner is to be put in a standing position, the user needs to pivot the rod and the handle grip about the second axis Y to an intermediate position, so that the pivotal tube 6 is pivoted together with the pivotal saddle 5 forward about the first axis X to insert the dovetail portion 62 into the groove 31. If the rod and the handle grip are tilted to the left or right, then the dovetail portion 62 is not insertable into the groove 31. After the dovetail portion 62 is inserted into the groove 31, the pivotal tube 6 is locked in the upper housing 3, thereby preventing the pivotal tube and the handpiece from swaying from side to side.

Figure 7:
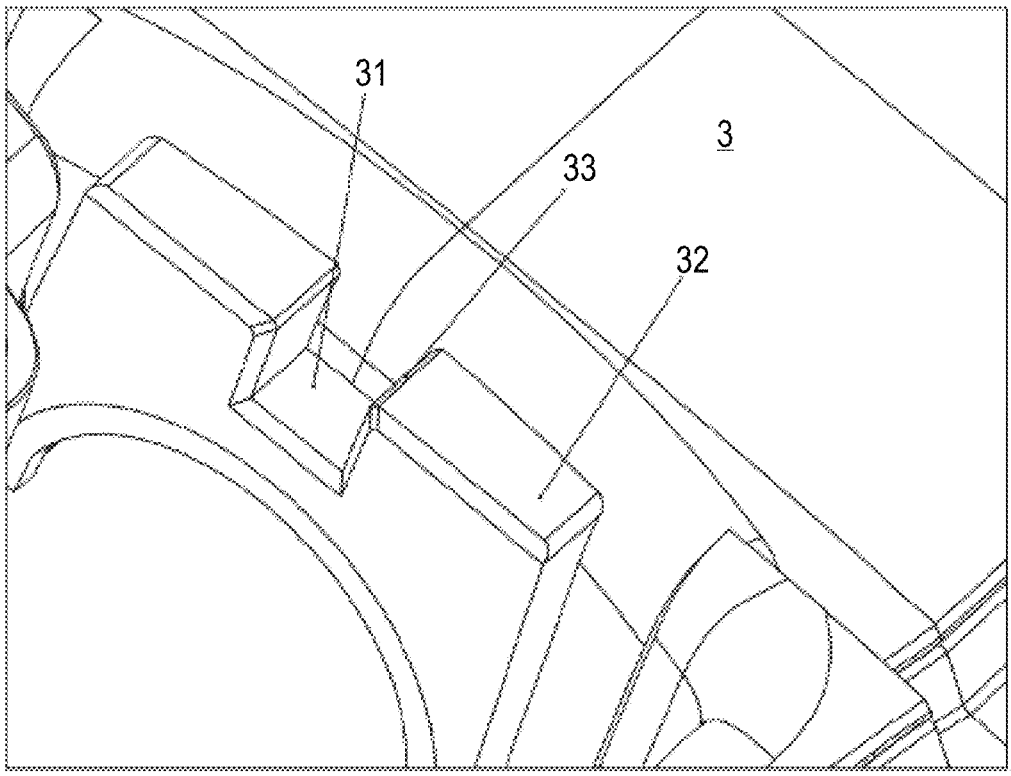
FIG. 7 is a partially enlarged view of the groove of the upper housing according to an embodiment of the present application, showing the structure of the groove in detail.

FIG. 7 is a partially enlarged view of the groove 31 of the upper housing 3 according to an embodiment of the present application, showing the structure of the groove 31 in detail. Referring to FIG. 7 and with continued reference to FIG. 5, the upper housing 3 is formed with support surfaces 32 on both sides of the groove 31, and the dovetail portion 62 comprises protrusions 63 extending outward on both sides thereof, the support surfaces 32 being configured to abut the protrusions 63 of the dovetail portion 62 and more specifically abut the lower surfaces of the protrusions 63. Thus, an extension part of the dovetail portion 62 fits the groove 31, and the protrusions 63 abut the support surfaces 32, thereby effectively preventing the pivotal tube 6 from turning from side to side relative to the upper housing. In an embodiment of the present application, the supporting surface 32 is an inclined plane that tilts slightly forward, for example, tilting forward by 1-2 degrees. As a result, the rod and the handle grip tilt slightly forward by 1-2 degrees relative to a fully upright direction to prevent the rod, the handle grip, and the recovery container from toppling over backward, which means that the handpiece as a whole is prevented from toppling over backward, so that the self-standing structure becomes more stable. In a preferred embodiment of the present application, the groove 31 is provided with a slope 33 at the entrance thereof, which makes it easier to insert the dovetail portion 62.

In another embodiment, the dovetail portion is provided on the upper housing and the groove is provided on the pivotal tube. In other words, the pivotal tube is provided with a groove as a joint portion, the brush is provided with a dovetail portion as a fitting portion, and the joint portion and the fitting portion are capable of engaging with each other, so that the pivotal tube is locked and not pivotable about a second axis.

Figure 8:
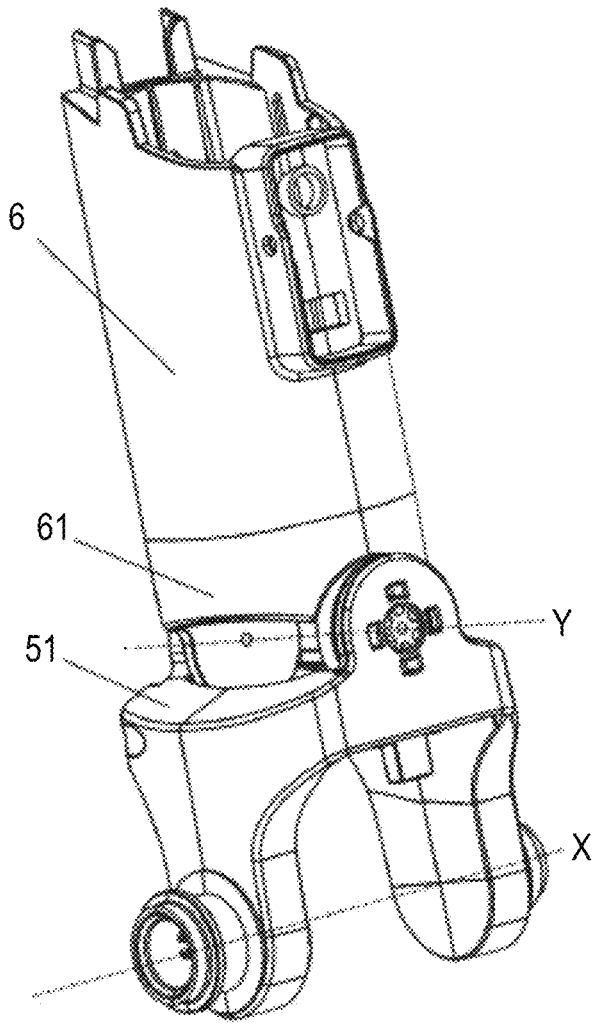
FIG. 8 is a perspective view of an embodiment of the present application with the pivotal tube and pivotal saddle assembled together, wherein the pivotal tube and pivotal saddle are vertically aligned to facilitate insertion of the dovetail portion into the upper housing.

FIG. 8 is a perspective view of an embodiment of the present application with the pivotal tube 6 and the pivotal saddle 5 assembled together, wherein the pivotal tube 6 and the pivotal saddle 5 are vertically aligned to facilitate insertion of the dovetail portion 62 into the upper housing 3. As shown in FIG. 7, the pivotal tube 6 comprises a pivotal portion 61 at the lower end thereof, the pivotal portion comprising a pivotal slope, and the pivotal saddle 5 comprises another pivotal portion 51 at the upper end thereof, said other pivotal portion 51 comprising another pivotal slope, wherein the pivotal slope and said other pivotal slope form a certain included angle when the pivotal tube 6 is pivotally connected to the pivotal saddle 5. The included angle is preferably in the range of 30 degrees to 40 degrees. For example, the included angle is up to 37 degrees, which means that the rod and the handle grip are tiltable to the left by up to 18.5 degrees and that likewise the rod and the handle grip are tiltable to the right by up to 18.5 degrees.

Figure 9:
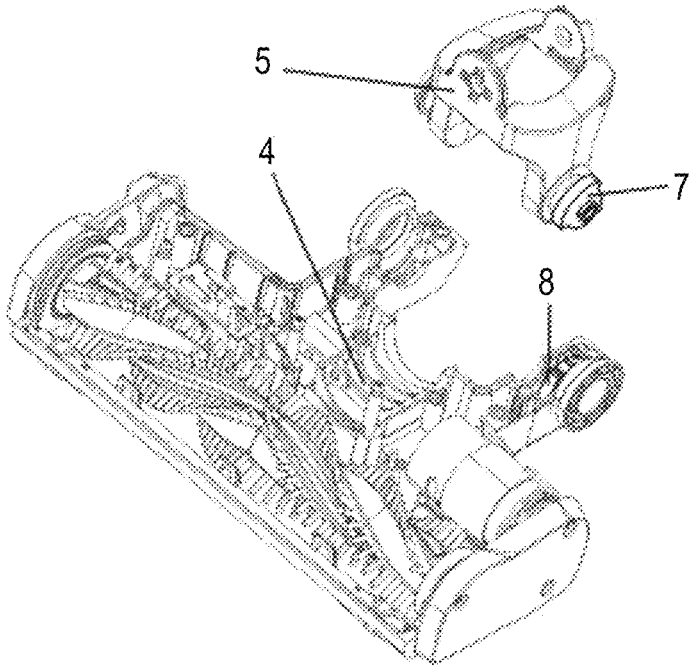
FIG. 9 is an exploded perspective view of the pivotal saddle and lower housing of an embodiment of the present application, wherein the pivotal saddle is fixedly connected to a cam on both sides thereof, the cam comprising a protrusion projecting radially outward, an elastic piece being fixed on the lower housing.
Figure 10:
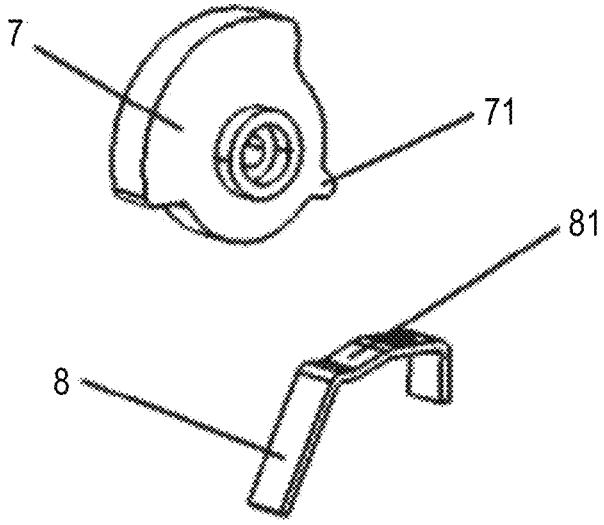
FIG. 10 is a perspective view of the cam and elastic piece of an embodiment of the present application, the elastic piece being formed with an elastic piece groove for engaging with the protrusion of the cam.

FIG. 9 is an exploded perspective view of the pivotal saddle 5 and the lower housing 4 of an embodiment of the present application, wherein the pivotal saddle 5 is fixedly connected to a cam 7 on both sides thereof, the cam 7 comprising a projection 71 that protrudes radially outward, an elastic piece 8 being fixed to the lower housing 4. The cam 7 is lockable into the elastic piece 8 to prevent the pivotal saddle from pivoting backward. FIG. 10 is a perspective view of the cam 7 and the elastic piece 8 of an embodiment of the present application, the elastic piece 8 being formed with an elastic piece groove 81 for engaging with the projection 71 of the cam 7. In an embodiment of the present application, the cam 7 comprises a projection 71 that protrudes radially outward, and the elastic piece 8 is formed with an elastic piece groove 81 for engaging with the projection 71 of the cam 7. When the rod and the handle grip are placed upright, the cam 7, through the projection 71 thereof, is automatically locked into the elastic piece groove 81, which also helps to prevent the handpiece from toppling over backward, so that the self-standing structure becomes more stable.

In conjunction with FIG. 11 to FIG. 15, a vacuum cleaner of a substitute embodiment of the present application is shown, wherein similar reference signs are used to denote the same or corresponding parts, and descriptions of corresponding parts are omitted to ensure brevity and conciseness of the description. In order to make it easier for the user to lock the handle grip or the handpiece to the brush so that the pivotal tube is conveniently lockable to the brush even when the pivotal tube is not completely upright and is not fully aligned with the fitting portion of the brush, without risks of possible deformation or even breakage of any fragile parts (for example, the dovetail portion) of the pivotal tube due to misalignment, in a vacuum cleaner of the present application, the upper housing is provided with a locking block slidable thereon, the locking block being configured to engage with the joint portion of the pivotal tube.

Figure 11:
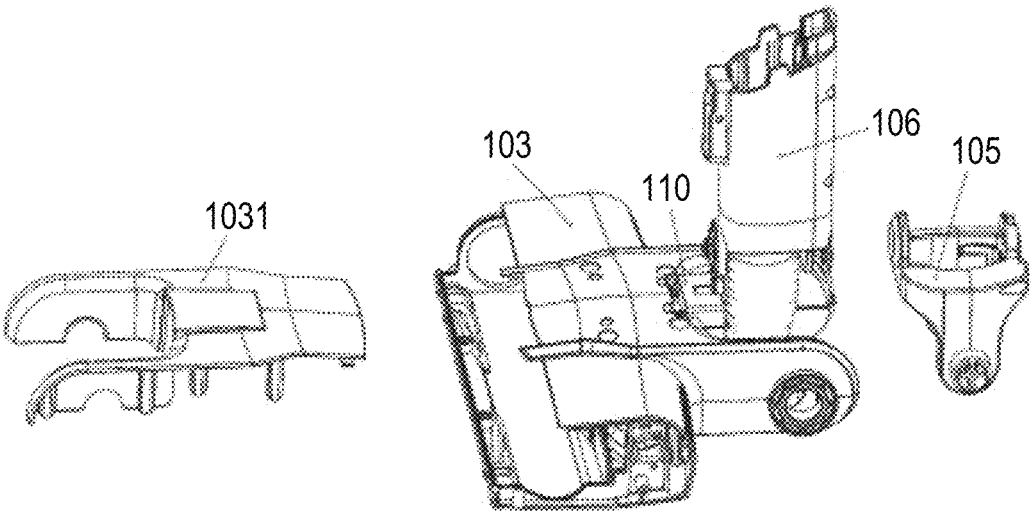
FIG. 11 is an exploded perspective view of a portion of a vacuum cleaner of a substitute embodiment of the present application, wherein the upper housing is provided with a locking block slidable thereon, the locking block being configured to engage with the joint portion of the pivotal tube.

FIG. 11 is an exploded perspective view of a portion of a vacuum cleaner of a substitute embodiment of the present application. As shown in FIG. 11, the vacuum cleaner comprises an upper housing 103, a pivotal tube 106, and a pivotal saddle 105. In order to show more clearly the locking block 110 provided on the upper housing 103, an upper housing cover 1031 on the upper housing 103 is removed to expose the locking block 110 provided under the upper housing cover 1031. The upper housing cover 1031 is disposed on the locking block 110 to prevent the locking block 110 from being detached from or leaving the upper housing 103 when sliding. In other words, the upper housing 103 and the upper housing cover 1031 accommodate the locking block 110 therein. In a preferred embodiment of the present invention, when the pivotal tube 106 is pivoted to stand upright on the brush, especially on the upper housing 103, and engage therewith, the locking block 110 is slidable on the upper housing 103, thereby making it easier to lock the handle grip or the handpiece to the brush. In a preferred embodiment of the present invention, the locking block 110 is configured to engage with the joint portion of the pivotal tube 106, preferably to engage with the dovetail portion 162 of the pivotal tube 106 (see FIG. 12). In a preferred embodiment of the present invention, the locking block is made of a high-hardness plastic material, for example, ultrahigh molecular weight polyethylene or polyetherketoneketone (PEKK), or of a metal material.

In an embodiment of the present application, since the locking block 110 slidable on the upper housing 103 is provided, even if the user has not aligned the dovetail portion 162 of the pivotal tube 106 with the locking groove 131 of the locking block, when the pivotal tube or the handpiece is pivoted to assume an almost upright position, the locking block 110 is subjected to an engagement force exerted by the dovetail portion 162, and the locking block 110 is pushed forward by the joint portion or dovetail portion to overcome the compressive force exerted by the spring, so that the spring 120 is compressed and the locking block 110 moves forward, thereby preventing the dovetail portion 162 from being subjected to forced resistance (if no locking block is provided, the dovetail portion is subjected to the forced resistance from the supporting surfaces 32 on both sides of the groove 31 of the upper housing), which thus lowers risks of possible breakage of the dovetail portion 162 caused by this forced resistance, improving the safety and durability of the vacuum cleaner.

Figure 12:
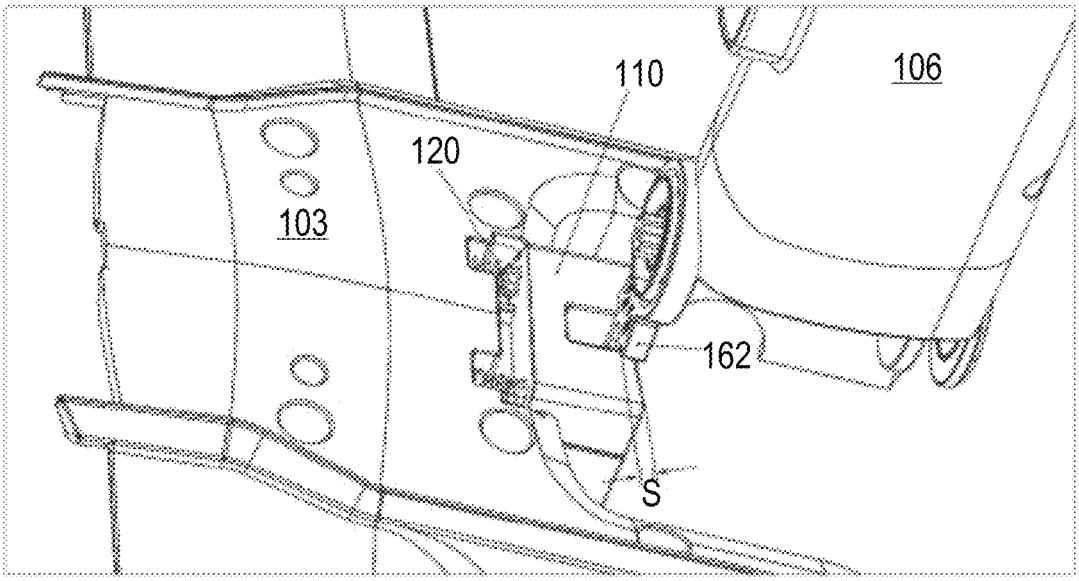
FIG. 12 is a partially enlarged view of a portion of a vacuum cleaner of a substitute embodiment of the present application, more clearly showing the engagement between the locking block slidably disposed on the upper housing and the joint portion of the pivotal tube.
Figure 13:
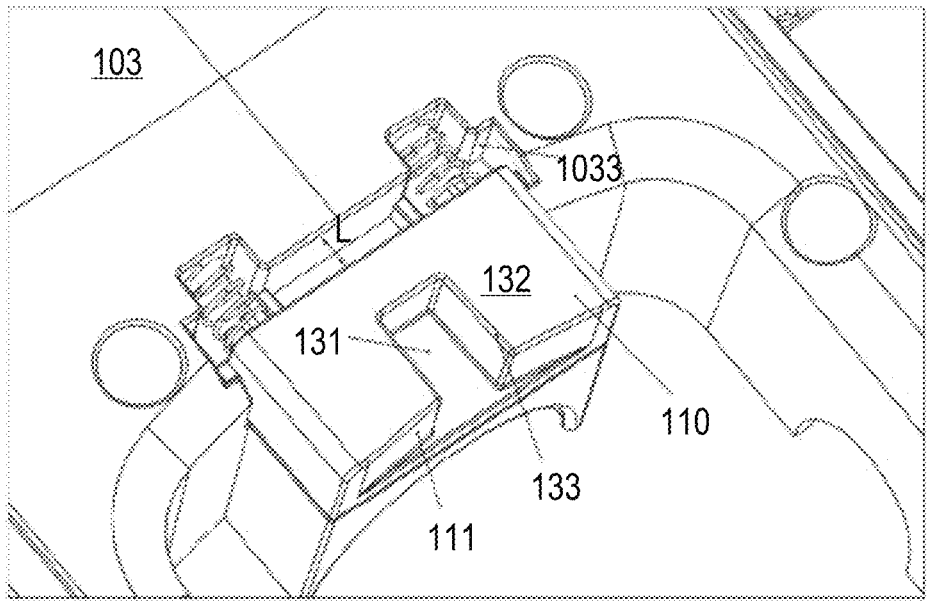
FIG. 13 is a partially enlarged perspective view of the upper housing and locking block of a substitute embodiment of the present application, with an elastic biasing element provided between the upper housing and the locking block, the elastic biasing element being preferably a spring.

FIG. 12 is a partially enlarged view of a portion of a vacuum cleaner of a substitute embodiment of the present application, showing more clearly the engagement between the locking block 110 slidably disposed on the upper housing 103 and the joint portion of the pivotal tube 106. FIG. 12 shows the state in which the dovetail portion 162 of the pivotal tube 106 is engaged in the locking block 110 when the handpiece assumes an upright, self-standing position. FIG. 13 is a partial perspective view of the upper housing 103 and the locking block 110 of a substitute embodiment of the present application, wherein an elastic biasing element, preferably a coil spring 120, is provided between the upper housing 103 and the locking block 110, the elastic biasing element being configured to bias the locking block 110 away from the upper housing 103. The locking block 110 is located on the upper housing 103, and the upper surface of the locking block 110 is substantially flush with the upper surface of the upper housing 103, so that the upper housing cover 1031 is conveniently fixed to the upper housing 103 from above and constrains the locking block 110. The locking block 110 is provided on the upper housing 103 to be slidable back and forth only on the upper housing 103. Such back-and-forth sliding motions are made possible by a shape-fitting structure between the lower surface of the locking block and the upper surface of the upper housing 103, which will be illustrated in FIG. 14. In a preferred embodiment of the present invention, a protrusion 113 (see FIG. 15) is provided at the front end of the locking block 110, the protrusion 113 preferably having the shape of a cross, so as to receive one end of the spring 120 thereon and constrain the spring 120.

Referring to FIG. 13 and with continued reference to FIG. 12, the locking block 110, in a central position thereof, is provided with a locking groove 131, the locking groove 131 being configured for the insertion of the joint portion or the dovetail portion 162 of the pivotal tube 106 therein. A support surface 132 is formed on the upper surface of the locking block 110, and the dovetail portion 162 comprises protrusions extending outward on both sides thereof, the support surface 132 being configured to abut the protrusions of the dovetail portion 162 (see FIG. 6) and more specifically abut the lower surfaces of the protrusions (see the embodiment shown in FIGS. 6 and 7). Thus, an extension part of the dovetail portion 162 fits the locking groove 131, and the protrusions abut the supporting surface 132, so that the pivotal tube 106 is effectively prevented from turning from side to side relative to the upper housing. In a preferred embodiment of the present application, the locking groove 131 is provided with a slope 133 at the entrance thereof, which makes it easier to insert the dovetail portion 162.

In addition, as shown in FIG. 13, in a preferred embodiment of the present invention, an angled guide surface 111 is provided at the rear end of the locking block 110 for guiding the joint portion into the locking groove 131. The guide surface 111 provides sliding contact with the pivotal member. The angled surface 111 helps guide or push the joint portion or the dovetail portion 162 into the locking groove 131 when the handle grip or the handpiece is pivoted closer to or near an upright position. Once the joint portion or the dovetail portion 162 is aligned with the locking groove 131, the joint portion or the dovetail portion 162 is pushable fully into the locking groove to keep the handle grip or the handpiece in an upright position, so that the vacuum cleaner is self-standing on the floor. An angle formed by the angled surface 111 may be in the range of 0-45 degrees, preferably in the range of 5-15 degrees.

In an embodiment of the present invention, the locking block is slidable on the upper housing by overcoming a force exerted by the spring. As shown in FIG. 13, the maximum distance over which the locking block 110 is slidable on the upper housing 103 is shown with reference sign "L", and this distance may be referred to as the sliding stroke of the locking block 110. In an embodiment of the invention, when the dovetail portion 162 is locked into the locking block, the dovetail portion 162 comes into contact with the locking block to temporarily displace the locking block and make it easier to assemble the dovetail portion 162 into the locking groove of the locking block. Making the locking block movable relative to the lower housing 103 helps better absorb the positional deviation between them when the pivotal member is locked relative to the upper housing, reducing damage caused between the dovetail portion and the groove or the locking block, because, compared with a case where no locking block is present and there is rigid contact between the dovetail portion and the groove, the locking block is movable relative to the lower housing to reduce the frictional force generated when the pivotal member is inserted into the upper housing, thus avoiding possible damage caused by misalignment.

In FIG. 12, the maximum actual pushing stroke of the dovetail portion 162 during the pivoting process is denoted by reference sign "S". In a preferred embodiment of the present invention, the sliding stroke of the locking block 110 is about 5 mm, while the actual pushing stroke of the joint portion or the dovetail portion 162 is about 4.4 mm. In other words, the sliding stroke of the locking block 110 is greater than the actual pushing stroke of the joint portion or the dovetail portion 162, so that when the joint portion or the dovetail portion 162 is placed upright, the joint portion will not be pushed so far that the locking block 110 reaches its maximum stroke to get the locking block 110 stuck. The maximum sliding stroke of the locking block 110 on the upper housing is greater than the maximum pushing stroke in the front-rear direction when the joint portion or the dovetail portion 162 pivots relative to the brush, and the block 110 in the present application has an angled guide surface 111 at the rear end thereof to help guide the joint portion or the dovetail portion 162 on the locking block 110, which are designs that help ensure that the pivotal tube 106 or the dovetail portion 162 thereof safely and freely enters the locking block 110, more specifically entering the locking groove 131 of the locking block 110.

Figure 14:
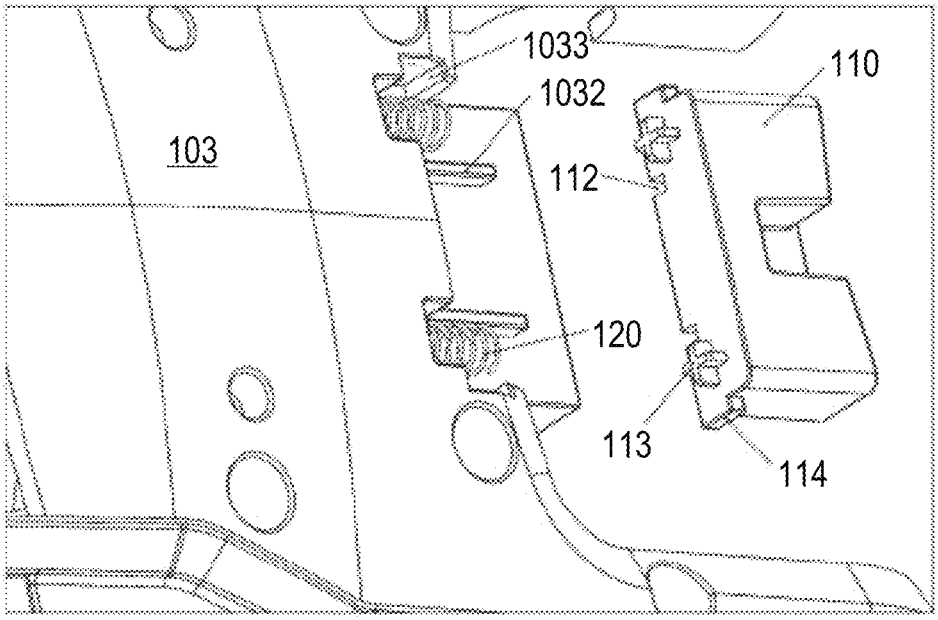
FIG. 14 is a partially enlarged exploded perspective view of the upper housing and locking block of a substitute embodiment of the present application, wherein the upper housing is provided with a rail and a chute is provided on the lower surface of the locking block, so that the locking block is slidable on the upper housing by causing the chute to slide on the rail.
Figure 15:
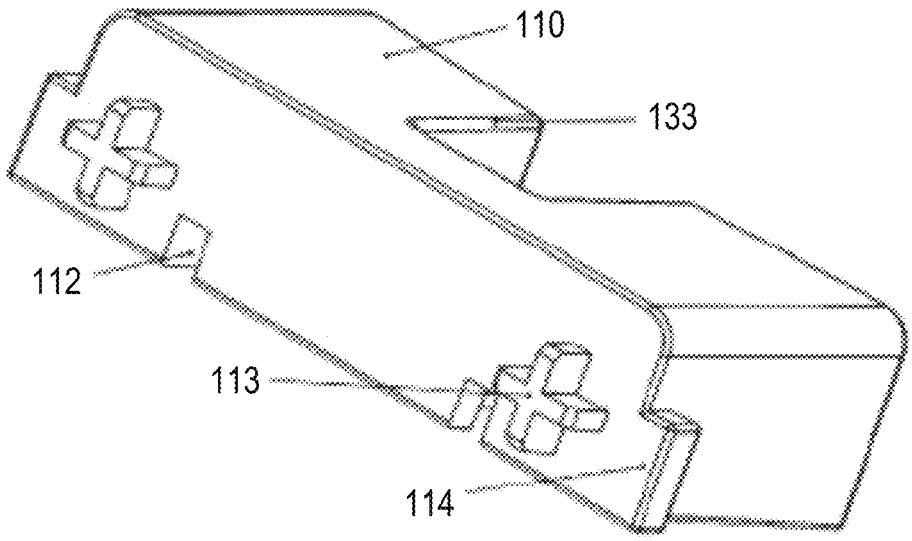
FIG. 15 is a perspective view of a locking block of a substitute embodiment of the present application.

FIG. 14 is a partially enlarged exploded perspective view of the upper housing and locking block of a substitute embodiment of the present application. FIG. 15 is a perspective view of a locking block of a substitute embodiment of the present application. As described above, the locking block 110 is provided on the upper housing 103 to be slidable back and forth only on the upper housing 103. In order to allow back-and-forth sliding motions, shape-fitting structures are provided on the lower surface of the locking block and on the upper surface of the upper housing 103. In a preferred embodiment of the present application, as shown in FIG. 14, the upper housing 103 is provided with a rail 1032, and the lower surface of the locking block 110 is provided with a chute 112 (see FIG. 15), so that the locking block 110 is slidable on the upper housing 103 by causing the chute 112 to slide on the rail 1032. Indeed, another embodiment not shown in the drawings is also conceivable, wherein, for example, the upper housing 103 is provided with a guide groove, and the lower surface of the locking block 110 is provided with a raised guide rail configured to slide in the guide groove, so that the locking block 110 is slidable back and forth on the upper housing 103.

In an embodiment of the present invention, the locking block 110 further comprises a stop structure configured to abut the upper housing to prevent an elastic biasing element from pushing the locking block 110 further away on the upper housing 103. As shown in FIGS. 14 and 15, in a preferred embodiment of the present invention, the stop structure comprises lugs 114 on both lateral surfaces of the locking block 110, the lugs 114 being provided away from the guide surface, in particular being provided adjacent to the front end of the locking block on both sides thereof. The upper housing 103 further comprises a corresponding stop surface 1033 (see FIGS. 13 and 14) configured to prevent the locking block 110 (more specifically, the lug 114) from moving beyond its stroke L, thus ensuring that the locking block 110 does not slide out of the upper housing 103.

In an embodiment of the present application, since the locking block 110 slidable on the upper housing 103 is provided, even if the user has not aligned the dovetail portion 162 of the pivotal tube 106 with the locking groove 131 of the locking block, when the pivotal tube or the handpiece is pivoted to assume an almost upright position, the locking block 110 is subjected to an engagement force exerted by the dovetail portion 162, and the locking block 110 is pushed forward by the joint portion or dovetail portion to overcome the compressive force exerted by the spring, so that the spring 120 is compressed and the locking block 110 moves forward, thereby preventing the dovetail portion 162 from being subjected to forced resistance (if no locking block is provided, the dovetail portion is subjected to the forced resistance from the supporting surfaces 32 on both sides of the groove 31 of the upper housing), which thus lowers risks of possible breakage of the dovetail portion 162 caused by this forced resistance, improving the safety and durability of the vacuum cleaner.

The locking block 110 preferably comprises an angled guide surface 111, lugs 114 provided on lateral surfaces thereof, and shape-fitting structures provided on the lower surface of the locking block 111 and on the upper surface of the upper housing 103, all of which are designs that help to better absorb the positional deviation between the dovetail portion and the locking groove when the pivotal tube or the handpiece is locked relative to the brush or the upper housing, reducing the damage caused between the dovetail portion and the locking groove or the locking block, wherein, compared with a case where no locking block is present, since the locking block is movable forward relative to the lower housing to reduce the frictional force generated when the pivotal member is inserted into the upper housing, risks of breakage of any parts due to misalignment are reduced or avoided.

Although this description has been given according to implementations, it is not that each implementation comprises only one independent technical solution, this description has been given in this manner only for the sake of clarity, and those of ordinary skill in the art should treat the description as an entirety, wherein the technical solutions provided in the embodiments may also be appropriately combined to form other implementations understandable to those of ordinary skill in the art. The scope of the present invention should be defined by the attached claims but not by the above description, and therefore it is intended to include all alterations that fall into the connotations and scope of equivalent essentials of the claims in the present invention.

It is readily apparent to those of ordinary skill in the art that the present invention is not limited to the details given in the above-described exemplary embodiments, and that the present invention may be implemented in other specific modes without departing from the spirit or basic characteristics of the present invention. Therefore, the above-described embodiments should be deemed exemplary and non-limiting.

The invention claimed is:

1. A vacuum cleaner comprising a handpiece, a brush, a rod, and a pivotal assembly that connects the handpiece and the brush, wherein the pivotal assembly comprises a pivotal tube and a pivotal saddle, the pivotal saddle being pivotally connected to the brush about a first axis such that the pivotal saddle is turnable back and forth relative to the brush; and the pivotal tube and the pivotal saddle are pivotally connected about a second axis, the pivotal tube being provided with a joint portion, the brush being provided with a fitting portion, the joint portion and the fitting portion being capable of engaging with each other, so that the pivotal tube is locked and not pivotable about the second axis, wherein the brush comprises an upper housing and a locking block, the locking block being slidable on the upper housing, the locking block comprising a locking groove as the fitting portion, wherein, when the pivotal tube is pivoted to an upright position, the joint portion comes into contact with the locking block and causes the locking block to slide, thus facilitating the engagement of the joint portion into the locking groove.

2. The vacuum cleaner as claimed in claim 1, wherein the fitting portion comprises a groove adjacent to one end of the pivotal tube and wherein the joint portion comprises a dovetail portion at a lower end of the pivotal tube, the dovetail portion being configured to be insertable into the groove.

3. The vacuum cleaner as claimed in claim 2, wherein the pivotal tube comprises a pivotal portion at the lower end thereof and wherein the groove opens vertically upward so that the dovetail portion is insertable into the groove when the pivotal tube is in a vertical plane passing through the pivotal portion.

4. The vacuum cleaner as claimed in claim 2, wherein the pivotal tube comprises a pivotal portion at the lower end thereof, the pivotal portion comprising a pivotal slope, and wherein the pivotal saddle comprises another pivotal portion at an upper end thereof, the other pivotal portion comprising another pivotal slope, wherein the pivotal slope and the other pivotal slope form an included angle between 30 degrees and 40 degrees when the pivotal tube is pivotally connected to the pivotal saddle.

5. The vacuum cleaner as claimed in claim 3, wherein the brush is formed with a support surface on both sides of the groove, the dovetail portion comprising protrusions extending outwardly on both sides thereof, the support surface being configured to abut the protrusions of the dovetail portion.

6. The vacuum cleaner as claimed in claim 3, wherein the groove is provided with a slope at an entrance thereof to insert the dovetail portion.

7. The vacuum cleaner as claimed in claim 5, wherein the support surface is an inclined plane that tilts slightly forward.

8. The vacuum cleaner as claimed in claim 2, wherein the brush comprises two front wheels and two rear wheels arranged adjacent to the pivotal saddle, and wherein the center of gravity of the handpiece is between the front wheels and the rear wheels.

9. The vacuum cleaner as claimed in claim 2, further comprising a cam fixedly connected to the pivotal saddle, and an elastic piece is fixed to the brush, the cam being lockable into the elastic piece to prevent the pivotal saddle from pivoting backward.

10. The vacuum cleaner as claimed in claim 9, wherein the cam comprises a projection protruding radially outward, and wherein the elastic piece is formed with an elastic piece groove for engaging with the projection of the cam.

11. The vacuum cleaner as claimed in claim 1, wherein the fitting portion comprises a dovetail portion adjacent to one end of the pivotal tube, and wherein the joint portion comprises a groove at a lower end of the pivotal tube, the dovetail portion being configured to be insertable into the groove.

12. The vacuum cleaner as claimed in claim 1, further comprising an elastic biasing element provided between the upper housing and the locking block, the elastic biasing element being configured to bias the locking block away from the upper housing, the elastic biasing element being preferably a spring.

13. The vacuum cleaner as claimed in claim 12, wherein the locking block is provided with an angled guide surface for guiding the joint portion into the locking groove.

14. The vacuum cleaner as claimed in claim 12, further comprising shape-fitting structures provided on a lower surface of the locking block and on an upper surface of the upper housing so that the locking block is slidable on the upper housing.

15. The vacuum cleaner as claimed in claim 14, wherein the locking block comprises a rail, and wherein the upper housing comprises a chute.

16. The vacuum cleaner as claimed in claim 12, wherein the locking block comprises a stop structure configured to abut the upper housing to prevent an elastic biasing element from pushing the locking block further away on the upper housing, the stop structure being a lug on a lateral surface of the locking block.

17. The vacuum cleaner as claimed in claim 12, wherein a front end of the locking block is provided with a protrusion to receive one end of the spring thereon, the protrusion having the shape of a cross.

18. The vacuum cleaner as claimed in claim 12, wherein the locking block is made of a high-hardness plastic or metal material, for example, ultrahigh molecular weight polyethylene or polyetherketoneketone (PEKK).

19. The vacuum cleaner as claimed in claim 12, wherein a maximum sliding stroke of the locking block on the upper housing is greater than a maximum pushing stroke in a front-rear direction when the joint portion pivots relative to the brush.

20. The vacuum cleaner as claimed in claim 12, wherein the brush further comprises an upper housing cover fixed on the upper housing, the locking block being accommodated in the upper housing and the upper housing cover.

21. The vacuum cleaner as claimed in claim 1, wherein the locking block is slidable in a direction perpendicular to the first axis.

22. The vacuum cleaner as claimed in claim 1, wherein, when the handle is in the in-use position, the fitting portion is spaced apart from and not engaged with the locking block.

23. The vacuum cleaner as claimed in claim 1, wherein the locking block is slidable in a direction substantially perpendicular to the first axis.

24. The vacuum cleaner as claimed in claim 1, wherein the locking block is positioned atop the upper surface and is directly slidable thereon.

25. The vacuum cleaner as claimed in claim 1, wherein the locking block is external to the upper housing such that the locking block is visible to a user when the joint portion is in contact with the locking block and when the joint portion is not in contact with the locking block.

* * * * *